United States Patent [19]

Weidner et al.

[11] 4,299,169

[45] Nov. 10, 1981

[54] GENERATOR FOR A SPIN PROJECTILE HAVING A GUIDE BAND

[75] Inventors: Peter Weidner, Breitenbrunn; Dietmar Stützle, Lauf, both of Fed. Rep. of Germany

[73] Assignee: Diehl GmbH & Co., Fed. Rep. of Germany

[21] Appl. No.: 118,202

[22] Filed: Feb. 4, 1980

[30] Foreign Application Priority Data

Feb. 7, 1979 [DE] Fed. Rep. of Germany ..... 2904502

[51] Int. Cl.[3] ..... F42C 11/02

[52] U.S. Cl. ..... 102/210

[58] Field of Search ..... 102/210; 310/339, 367, 310/369

[56] References Cited

U.S. PATENT DOCUMENTS

| | | | |
|---|---|---|---|
| 3,239,678 | 3/1966 | Kolm et al. | 102/210 |
| 3,470,818 | 10/1969 | Harnau | 102/210 |
| 3,539,841 | 11/1970 | Riff | 310/369 |

*Primary Examiner*—Charles T. Jordan

*Attorney, Agent, or Firm*—Scully, Scott, Murphy & Presser

[57] ABSTRACT

A generator for generating electrical ignition energy through a piezo element in a spin projectile. A guide band on the projectile deforms upon entry into the riflings of a weapon barrel. To generate the ignition energy due to the deformation of the guide band, the piezo element is a tubular member polarized radially relative to the longitudinal axis of the projectile. The outer circumference of the piezo element lies against the projectile shell. The piezo element is stiffened along its inner circumference by a stiffener ring positioned thereagainst.

3 Claims, 1 Drawing Figure

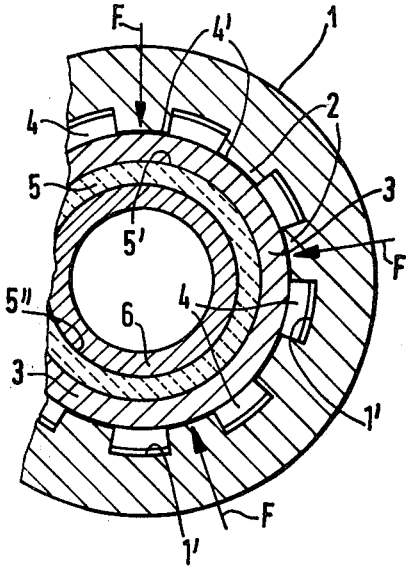
F
4'
1
4
2
5
3
5'
F
5''
6
4
3
1'
F
1'

GENERATOR FOR A SPIN PROJECTILE HAVING A GUIDE BAND

BACKGROUND OF THE INVENTION

1. Field of the Invention

The present invention relates to a generator for the generation of electrical ignition energy through the intermediary of piezo element arranged within a spin projectile having a guide or rotating band which deforms upon entry into the riflings of a weapon barrel.

2. Discussion of the Prior Art

In known generators of the above-mentioned type, the acceleration which acts in the direction of the longitudinal axis of the projectile is the criterion for the charging of the piezo element and, consequently the availability of the ignition or detonation energy. A further criterion which can be considered for the setting of an arming arrangement is the spin of the projectile.

In order to increase the operational reliability, it is desired that, for the control of the arming sequence, there be utilized entirely different criteria which are predicated on the environmental conditions of the projectile.

SUMMARY OF THE INVENTION

Accordingly, it is an object of the present invention to achieve the generation of the electrical ignition energy through a further criterion in addition to the above-mentioned criteria.

Inventively, the foregoing object is achieved for a generator of the above-mentioned type in that the piezo element is in the shape of a tubular member and is polarized in a direction extending radially to the longitudinal axis of the projectile, and wherein the external circumference of the piezo element lies against the projectile shell. The desired ignition or detonation voltage will then occur when the guide band deforms upon entry into the riflings of the weapon barrel. The deformation of the guide band in the region of the riflings acts as a compressive pressure on the projectile shell. This pressure propagates to the piezo element so that the desired ignition or detonation energy can be taken off from the piezo element. Accordingly, the entry of the guide or rotating projectile band into the riflings of the weapon barrel is utilized as the criterion for the generation of the ignition or detonation energy.

The forces which occur during the deformation of the guide band are significant, so that one can calculate with a spontaneous depolarization of the piezo element. During the spontaneous depolarization, a maximum charge can be retrieved from the piezo element.

A further advantage of the invention resides in that the surface of the piezo element which is determinative of the generation of the charge is not limited by the caliber of the projectile since the height of the tubular piezo element is freely selectable in conformance with the elevation of the guide band and the projectile shell regions contiguous thereto, on which there acts the compressive pressure. Moreover, the tubular piezo element requires only little space. The interior space of the tubular member remains available for the positioning of further elements of an ignition and arming arrangement.

In order to be able with assurance to prevent any destruction of the piezo element during the entry of the guide band into the riflings of the weapon barrel, in a preferred embodiment of the invention the piezo element is reinforced along its inner circumference. Preferably, a stiffener ring is provided for this purpose along the inner circumference.

BRIEF DESCRIPTION OF THE DRAWING

Further advantageous embodiments of the invention may now be ascertained from the following detailed description of a preferred embodiment, taken in conjunction with the single FIGURE of the accompanying drawing schematically showing a fragmentary cross-section of a projectile located within a weapon barrel.

DETAILED DESCRIPTION

With particular reference to the drawing, a weapon barrel 1 is provided with riflings 2. A projectile which is to be fired from the weapon barrel includes a projectile shell 3 to the exterior circumference of which there is fastened a deformable, metallic guide or rotating band 4.

A tubularly-shaped piezo element 5 is positioned to closely lie against the inner circumference of the projectile shell 3. Interiorly of the piezo element 5, the latter is supported by a stiffener ring 6. The piezo element 5 is radially polarized, and is metallized along its inner circumference 5'' and along its outer circumference 5'. The thus formed coatings are connected to the ignition or detonation circuit which is to be charged (not shown).

In the initial condition, the guide band 4 is of uniform thickness along its entire circumference, whereby the outer diameter of the guide band is slightly smaller than the diameter of the weapon barrel in the region of the bottom 1' of the interspaces between the riflings 2. After the firing of the projectile, the guide band 4 enters into the riflings 2. Compressed hereby, before anything else, it is within the areas 4' adjoining the riflings 2. The intermediate regions serve for the transfer of the twist of the riflings in the weapon barrel to the projectile.

The compressing of the guide ring in the areas 4' exerts itself on the projectile shell 3 as a force acting in the direction of the arrows F. Through the projectile shell 3 this force is transmitted to the piezo element which is clamped between the stiffener ring 6 and the projectile shell 3. Tapped off at the coatings 5' and 5'' the thereby produced ignition or detonation energy. Since the pressure which occurs during the deformation of the guide band is significant in the areas 4', there can be achieved the depolarization of the piezo element.

We claim:

1. In a generator for the generation of electrical ignition energy including a spin projectile having a guide band; and a piezo element in said spin projectile, said guide band being deformed upon entry of said projectile into the riflings of a weapon barrel; the improvement comprising: said piezo element being a tubular member polarized radially relative to the longitudinal axis of said projectile, the outer circumference of said piezo element being positioned against the shell of said projectile.

2. Generator as claimed in claim 1, comprising means for stiffening said piezo element along the inner circumference thereof.

3. Generator as claimed in claim 2, said stiffening means comprising a stiffener ring positioned against the inner circumference of said piezo element.

* * * * *